US005481979A

United States Patent [19]

Walder

[11] Patent Number: 5,481,979

[45] Date of Patent: Jan. 9, 1996

[54] PRACTICE DUMMY FOR AN EXPLOSIVE BODY

[75] Inventor: Herbert Walder, Zürich, Switzerland

[73] Assignee: I.L.E.E. AG Industrial Laser and Electronic Engineering, Switzerland

[21] Appl. No.: 189,662

[22] Filed: Feb. 1, 1994

[30] Foreign Application Priority Data

Feb. 3, 1993 [CH] Switzerland ..... 00317/93

[51] Int. Cl.[6] ..... F42B 8/28

[52] U.S. Cl. ..... 102/498; 102/355; 434/11

[58] Field of Search ..... 102/355, 498, 102/529, 482; 362/110; 434/11; 446/473

[56] References Cited

U.S. PATENT DOCUMENTS

| | | | |
|---|---|---|---|
| 4,421,319 | 12/1983 | Murphy | 273/416 |
| 4,461,117 | 7/1984 | Gott | 446/473 |
| 4,944,521 | 7/1990 | Greeno | 102/498 |
| 5,074,793 | 1/1991 | Hambric et al. | 434/11 |
| 5,246,372 | 9/1993 | Campagnuolo et al. | 434/11 |

FOREIGN PATENT DOCUMENTS

| | | |
|---|---|---|
| 1116103 | 8/1960 | Germany . |
| 2633964 | 1/1979 | Germany . |
| 3837998 | 11/1988 | Germany . |

*Primary Examiner*—Charles T. Jordan
*Attorney, Agent, or Firm*—Ostrolenk, Faber, Gerb & Soffen

[57] ABSTRACT

A practice dummy for simulating a handgrenade or another explosive weapon includes a plurality of infrared light emitting diodes. A light signal from these diodes is used for simulating the explosion. The light signal can be received by suitable detectors, such that the effect of the dummy can be detected in practice combat. Similar practice dummies can also be produced for the simulation of other weapons, such as mines, mortar shells, etc. The dummy therefore allows a more realistic combat simulation for practice and instruction. The light signals emitted by the diodes can be adjusted to have a range similar to the explosion to be simulated. Such a dummy is easy to construct and compatible with existing optical simulation systems.

12 Claims, 3 Drawing Sheets

PRACTICE DUMMY FOR AN EXPLOSIVE BODY

BACKGROUND OF THE INVENTION

1. Field of the Invention

The present invention relates to a practice dummy for an explosive body.

In military practice combat it has become more and more popular to use electronic dummy weapons instead of real weapons. The effects of the weapons are thereby simulated by signals that are detected by suitable sensors.

2. Description of the Prior Art

Well known practice weapons of this kind are e.g. laser devices that can be used as practice guns or mounted on existing guns. A gun shot is simulated by a laser beam. The participants of the practice combat are wearing detectors on their body for detecting the laser beams and displaying a hit. Similar laser systems are offered for simulating anti-tank weapons.

These systems allow a realistic simulation of a part of the combat. They cover, however, only a small section of the situations that are encountered in real combat action.

U.S. Pat. No. 5,047,793 discloses a dummy for a land mine, which sends out a radio signal for simulating an explosion. Such a device is, however, expensive because it requires a radio emitter and because it makes it necessary that all participants of a practice combat wear corresponding radio receivers. Furthermore, the emission characteristic of a radio emitter is not a good approximation for the range of action of an explosion.

SUMMARY OF THE INVENTION

Hence, it is a general object of the invention to provide a practice dummy for an explosive body and a method for simulating an explosion which avoid the disadvantages of the prior art devices and methods.

Now, in order to implement these and still further objects of the invention, which will become more readily apparent as the description proceeds, the practice dummy is manifested by the features that it comprises an optical signal emitter means arranged in the dummy for generating a light signal for simulating the explosion.

The method for simulating the effect of an explosion having a center of explosion is manifested by the features that a light source is located in the center of explosion and light signals are emitted by the light source for simulating the explosion.

The inventive practice dummy allows a simulation of the effect of any explosive weapon. The invention is especially suited for replacing handgrenades, mines, etc. These weapons play an important role in combat.

The dummy emits optical signals for simulating the explosion. Such signals can be compatible with the signals detected with conventional detectors, as they are used for laser based practice guns. In this way it is possible to simulate a whole range of different weapons using one single detector.

The effective sphere of action of a detonation can be simulated very realistically by the optical signals. Since the signals cannot penetrate heavy obstacles, the participants can seek cover in behind them.

Preferably, the light signals are emitted in the visible or near infrared spectral range.

BRIEF DESCRIPTION OF THE DRAWING

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
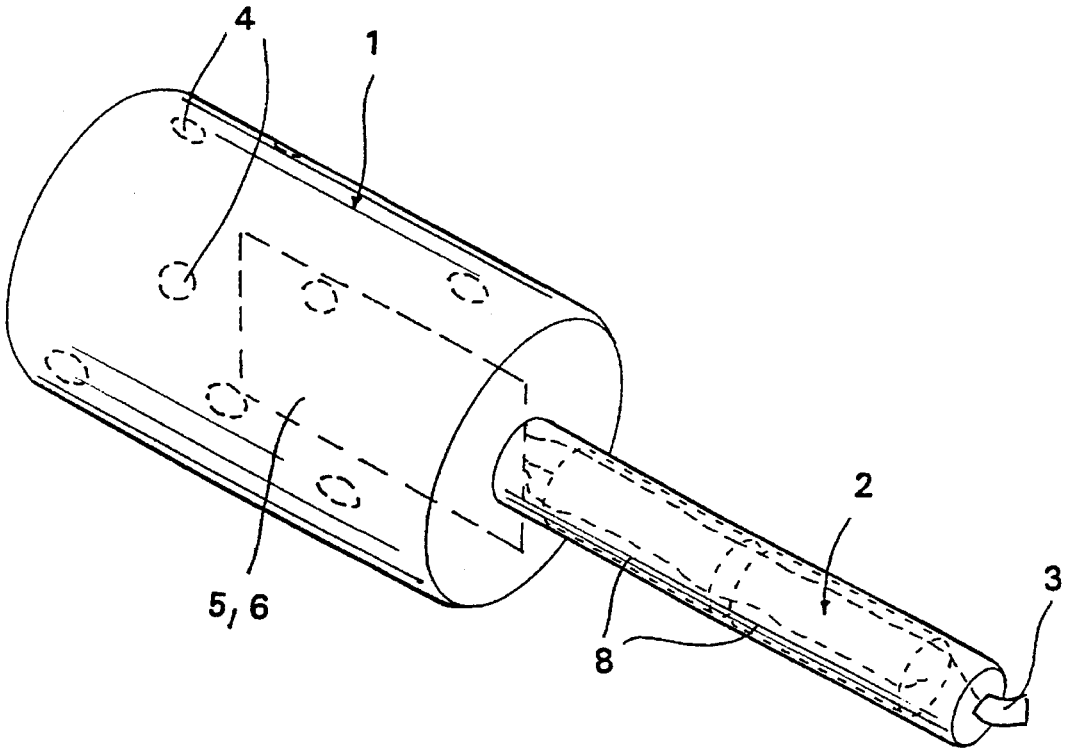
FIG. 1 shows a schematic view of a practice dummy for a handgrenade.

FIG. 1 shows a schematic embodiment of the invention in the form of a practice dummy for a handgrenade. The handgrenade comprises a head 1 and a handle 2. A safety release mechanism is located at the bottom end of the handle 2. In this way, the dummy handgrenade has the shape of a conventionally used model. The weight of the dummy is chosen to be equal to the weight of an original handgrenade.

Several infrared light emitting diodes 4 and a control circuit 5, 6 are arranged in the head 1 of the grenade. The head 1 is made of a material that is transparent for allowing emission of the infrared light of the light emitting diodes 4. Two batteries are arranged in the handle 2 of the device.

Upon actuation of the safety release mechanism 3 a timer is started in the control circuit 5, 6. After a given time, the timer releases the signal, which is emitted by the diodes during a given time span. This signal can be detected by the detectors carried by the combat participants. In this way, the practice dummy simulates the effect of a real handgrenade. Once the release mechanism 3 is actuated, the grenade must be thrown into a target area, where, seconds later, it emits its optical signal for simulating the explosion. The release mechanism 3 is preferably provided with a safety bolt for preventing an unintentional release.

Figure 2:
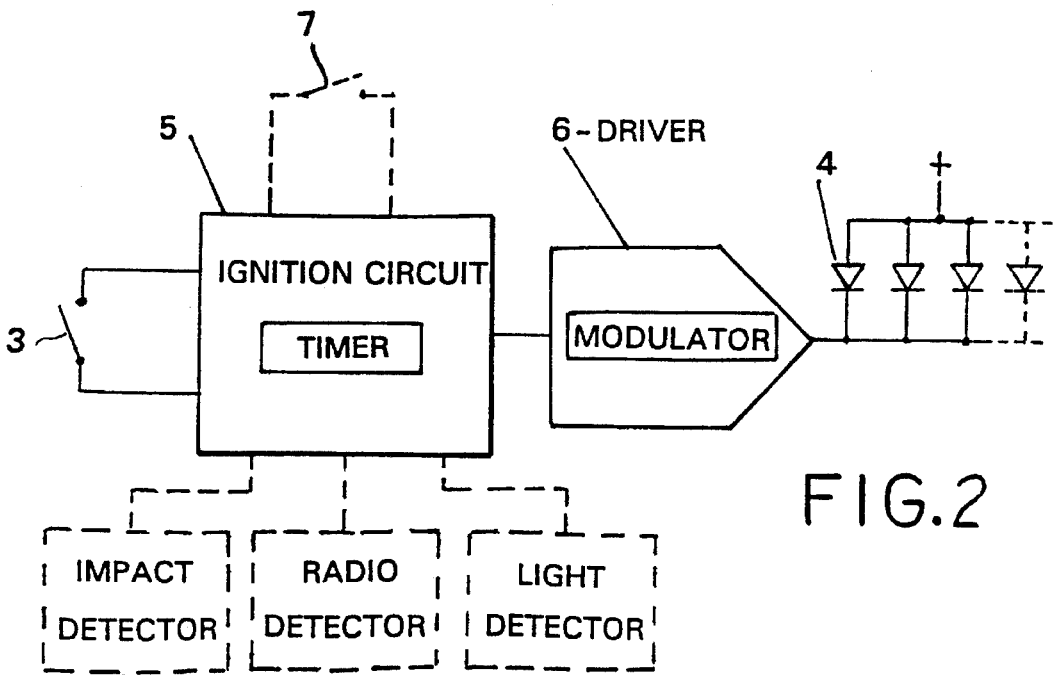
FIG. 2 shows a simplified diagram of the control circuit of a hand grenade.

A simplified block circuit diagram of the handgrenade is shown in FIG. 2. A ignition circuit 5 controls the time and length of the signal to be emitted. The ignition circuit 5 also monitors the state of the release mechanism or release switch 3. The ignition circuit controls a driver 6 for the light emitting diodes 4. This driver 6 comprises an amplifier and, if necessary, a suitable modulator for signal modulation.

The ignition circuit 5, as well as, at least parts of the driver 6 can also be incorporated in a microprocessor system.

An actuation of the switch (safety mechanism) 3 starts a timer of the ignition circuit 5. After a given time (a desired number of seconds), the ignition circuit activates the driver 6, which operates the light emitting diodes 4 during a given time span.

After switching off the diodes, it is basically possible to restart the cycle by a second actuation of the release switch 3. It is, however, also possible to allow a next cycle only after actuation of an optional reset switch 7, which can, for example be arranged inside the housing so that it is not accessible without opening the grenade.

In a preferred embodiment, the driver 6 comprises a conventional remote control integrated circuit, as is used in consumer electronic goods. In this way it is possible to easily transmit information from the grenade to the detectors by suitable modulation of the emitted light. This information can, for example identify the kind of dummy that 'exploded' (handgrenade), the thrower of the dummy, the time of the explosion, etc.

The receiver of the signals can be a conventional detector as is used, for example for laser based practice guns. If necessary, its sensitivity can adjusted.

The power of the dummy's signal and the sensitivity of the detector are preferably adjusted such that the only signals that are detected are those located within the range of action of a real handgrenade.

A handgrenade as shown in FIG. 1 is only one of the possible embodiments of the invention. The shape and kind of the explosive body to be simulated can be chosen from a wide range of possibilities. For example, it is possible to provide dummies for differently shaped handgrenades (such as egg-shaped handgrenades), but also for other weapons, such as mines, bombs, mortar shells, etc.

In the form of a mine, the dummy is especially suited for practicing mine seeking. The dummy is thereby provided with a suitable fuse or ignition mechanism of a conventional mine, which releases the signal if the mine seeker makes a mistake.

The control circuit and the release mechanism can be chosen according to the weapon to be simulated. A piezo-electric or mechanical detector can be used for triggering the device on shock or impact. In this way, the signal can be released when a thrown or dropped practice dummy hits the ground. The control circuit can also comprise a radio, laser light or infrared receiver, such that the signal can be released by remote control from a distance. Other suitable trigger mechanisms are known from conventional weapons.

The above embodiment describes an optical signal transmission between dummy and detectors. For this purpose, the dummy contains several infrared light emitting diodes, which are arranged such that realistic emission characteristics are achieved corresponding to the pressure or fragment distribution of a real explosion. It is, however, possible to use other light sources as well, such as laser diodes, flash lamps, etc.

In addition to the optical signal to be received by the detectors, the dummy can also emit a loud acoustic signal upon detonation. This allows a more realistic simulation of the effect of the detonation, because an explosion is heard in the surroundings. For this purpose, the control circuit can drive a electric, electro-chemical or electro-mechanical sound emitter.

At the end of a practice combat, the used grenades must be collected. The dummies can be colored, at least in part, with a signal color, such that they are found easily. It is even possible to provide them with a small radio, light or ultrasonic detector, which can detect a 'calling' signal and release an answering signal. This answering signal can be the same signal as used for indicating the explosion of the grenade. This signal can then be located by a suitable detector. Preferably, however, the answering signal is a signal that can be localized easily, such as an acoustic signal.

Figure 3:
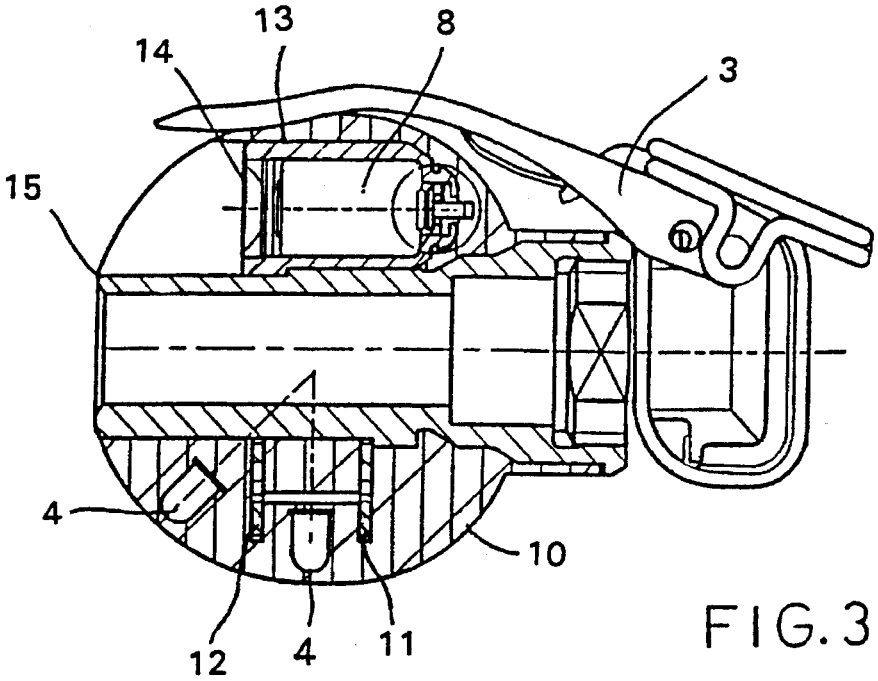
FIG. 3 shows the preferred embodiment of a handgrenade.
Figure 4:
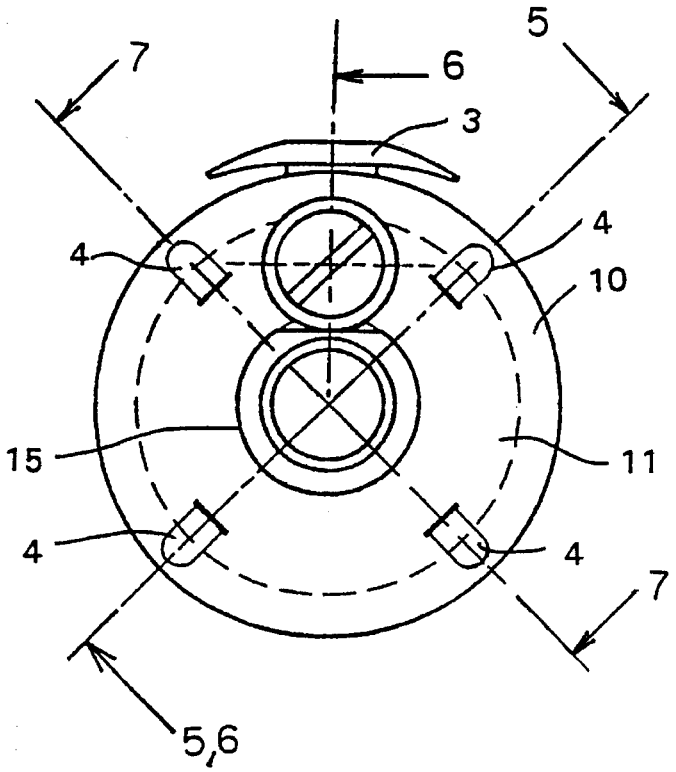
FIG. 4 is a front view of the handgrenade of FIG. 3.

The presently preferred embodiment of a dummy for a handgrenade is illustrated in FIGS. 3 and 4. FIG. 3 shows body 10 of the dummy in sectional view and the safety mechanism 3' in side view.

The safety mechanism 3' is constructed and can be operated like any conventional safety mechanism known to the person skilled in the art.

Figure 5:
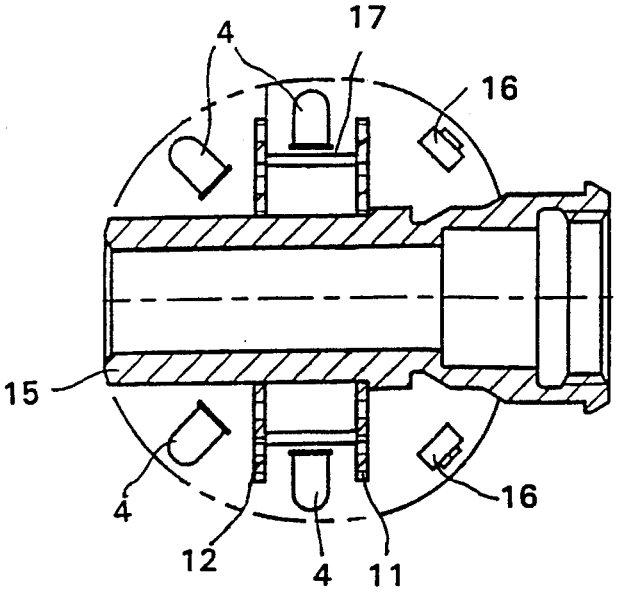
FIG. 5 is a sectional view along line A—A of FIG. 4 not showing the safety lever.
Figure 6:
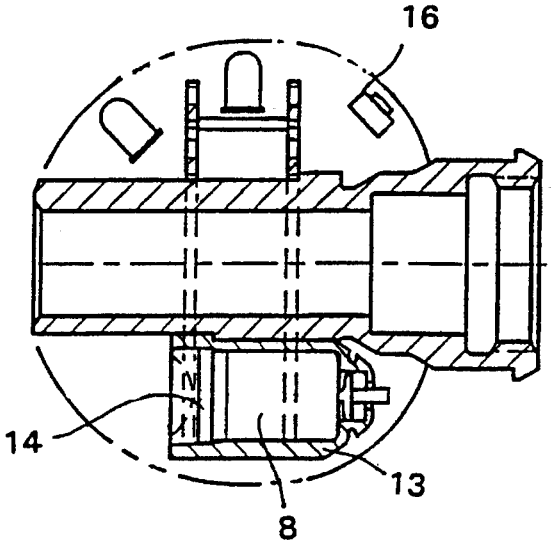
FIG. 6 is a sectional view along line B—B of FIG. 4.
Figure 7:
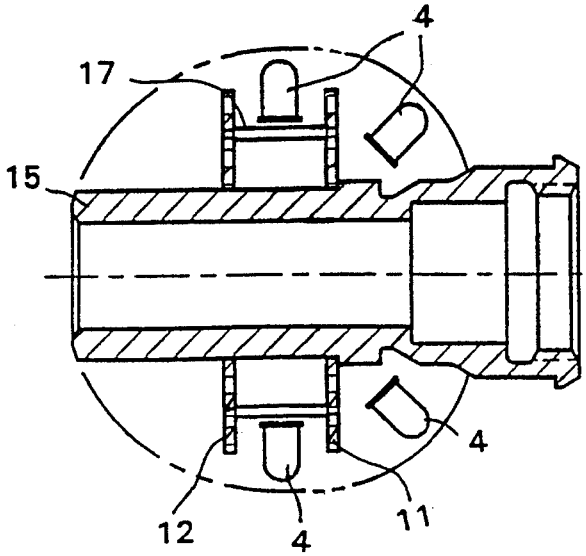
FIG. 7 is a sectional view along line C—C of FIG. 4.

The arrangement of the components within the body 10 is shown in sectional view in FIGS. 5–7. In these figures, the safety mechanism is not shown and the body 10 is only indicated by its circumferential line.

The eight light emitting diodes 4 are arranged within the body 10 in such a way that they can emit light in all directions. They are soldered to two printed circuits 11, 12, which are located at a distance from each other. Connecting pins 17 form the electrical contacts between the printed circuits 11 and 12. Furthermore, two push switches 16 are provided, which are also connected to the printed circuits 11, 12. By means of these switches, the dummy can be switched on and off.

The battery 8 is located in a container 13 having a removable cover 14. The printed circuits 11, 12 and the battery container 13 are mounted to a central support 15 made of metal, which also carries the safety mechanism 3'.

After mounting the electrical components, the printed circuit boards and the battery container to the support 15, all these parts are cast in a plastic material, which is slightly elastic and transparent to infrared light, and which forms the spherical body 10. The cover 14 of the battery container 13 remains accessible.

In this way a compact and sturdy handgrenade dummy can be constructed. By casting the electronic components in a plastic material, they are optimally protected from the environment, and the dummy works reliably even under adverse environmental conditions and when subjected to shocks.

Inventive dummies can be used as a replacement for practicing the use of a wide range of explosive weapons. Therefore, they are especially suited for applications in military and paramilitary exercise, sport, and instruction.

While there are shown and described present preferred embodiments of the invention, it is to be distinctly understood that the invention is not limited thereto, but may be otherwise variously embodied and practiced within the scope of the following claims.

I claim:

1. A practice dummy for an explosive body comprising:

a housing:

an optical signal emitter means arranged in the housing for generating a light signal for simulating an explosion; and a modulator for modulating the light signal for transmitting information.

2. The practice dummy of claim 1 wherein said optical signal emitter means comprises a plurality of light emitting diodes.

3. The practice dummy of claim 1 comprising a control circuit means for determining a timing of the explosion to be simulated.

4. The practice dummy of claim 3 wherein said control circuit means comprises a release switch and a timer circuit being triggered by said release switch.

5. The practice dummy of claim 3, wherein said control circuit means comprises an impact detector.

6. The practice dummy of claim 3, wherein said control circuit means comprises a radio detector.

7. The practice dummy of claim 3, wherein said control circuit means comprises a light detector.

8. The practice dummy of claim 1, wherein the housing is made of an infrared transparent plastic material and said optical signal emitter means and the modulator are cast in said plastic material of said housing.

9. The practice dummy of claim 3 comprising a reset means, wherein said control circuit is operatively connected to said reset means so that after sending said signal, the control circuit cannot be operated again until actuation of said reset means.

10. The practice dummy of claim 1 comprising a call detector means for releasing a locatable reply signal upon detection of a call signal.

11. The practice dummy of claim 1 having the shape of a handgrenade.

12. The practice dummy of claim 4, wherein the housing is made of an infrared transparent plastic material and the practice dummy further comprises:

a central metal support cast into said plastic material and having a first end extending out of said plastic material;

a safety release mechanism arranged outside of said housing and being attached to said first end of said central metal support; and a plurality of electronic components and a printed circuit board mounted on said central metal support and cast into said plastic material.

* * * * *